US006250247B1

(12) United States Patent
Chu

(10) Patent No.: US 6,250,247 B1
(45) Date of Patent: Jun. 26, 2001

(54) COMBINATION SPHERICAL WHISTLE

(76) Inventor: Shu-Hsun Chu, No. 261, Ta Chu Road, Lu Chu Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/379,735

(22) Filed: Aug. 24, 1999

(51) Int. Cl.[7] ..... G10K 5/00
(52) U.S. Cl. ..... 116/137 R; 446/202; 446/216
(58) Field of Search ..... 116/137 R; 446/202, 446/203, 204, 205, 206, 216, 397; D21/411

(56) References Cited

U.S. PATENT DOCUMENTS

| | | | | |
|---|---|---|---|---|
| 2,877,598 | * | 3/1959 | Seron | 446/204 |
| 3,323,251 | * | 6/1967 | Henry | 446/206 |
| 4,180,537 | * | 12/1979 | Danova | 156/61 |
| 4,651,613 | * | 3/1987 | Harrison | 84/95.2 |
| 5,049,107 | * | 9/1991 | De Nittis | 446/397 |
| 5,260,512 | * | 11/1993 | Chamette et al. | 84/644 |

* cited by examiner

*Primary Examiner*—Andrew H. Hirshfeld
*Assistant Examiner*—R. Alexander Smith

(74) *Attorney, Agent, or Firm*—Rosenberg, Klein & Lee

(57) ABSTRACT

A combination spherical whistle formed by hooking up elongated, hollow, smoothly arched front, rear, left, right, top and bottom whistle elements with one another, the whistle elements each having two smoothly curved end portions at two distal ends, two bearing faces bilaterally symmetrically disposed in the middle between the smoothly curved end portions, two symmetrical pairs of hooked portions respectively provided at the connecting areas between the smoothly curved end portions and the bearing faces, the end portions of each of the whistle elements being respectively attached to the bearing faces of the other whistle elements, the hooked portions of each of the whistle elements being hooked up with the hooked portions of the other whistle elements, the front whistle element and the rear whistle element each further having a trapezoidal recess at one bearing face for easy installation of the top whistle element; the top whistle element has an air outlet, a mouthpiece formed integral with one end portion thereof adjacent to the air outlet and defining an air inlet, a cover plate fastened to an inside wall thereof and defining a resonant chamber in communication between the air inlet and the air outlet, and a vibrator received in the resonant chamber.

1 Claim, 6 Drawing Sheets

COMBINATION SPHERICAL WHISTLE

BACKGROUND OF THE INVENTION

The present invention relates to a whistle, and more particularly to a combination spherical whistle, which is comprised of six elongated, hollow, smoothly arched whistle elements detachably hooked up with one another, forming a spherical structure.

A variety of whistles have been disclosed for use in conducting traffics, making a communication, playing games, giving a warning signal, etc. A regular whistle is generally comprised of an air inlet, a resonant chamber, a vibrator, and at least one air outlet. By blowing air through the air inlet into the resonant chamber to vibrate the vibrator, a sharp sound is produced. There is also known another structure of whistle, which is comprised of a mouthpiece unit and a resonant chamber unit. The mouthpiece unit has an air inlet at one end, an air outlet at one opposite end in communication with the resonant chamber in the resonant chamber unit, and a movable whistle element received in the tubular body thereof between the air inlet and the air outlet. The aforesaid prior art whistles commonly have a fixed body that is not detachable, i.e., the whistles are presented in the finished form.

SUMMARY OF THE INVENTION

The present invention provides a combination spherical whistle, that can be detachably assembled by the user. According to the present invention, the combination spherical whistle is formed by hooking up elongated, hollow, smoothly arched front, rear, left, right, top and bottom whistle elements with one another. The rear whistle element is mounted with a split ring to hold a cord for hanging. The top whistle element comprises an air outlet, a mouthpiece formed integral with one end portion thereof adjacent to the air outlet and defining an air inlet, a cover plate fastened to an inside wall thereof and defining a resonant chamber in communication between the air inlet and the air outlet, and a vibrator received in the resonant chamber. A sharp sound is produced when a current of air is blown through the air inlet into the resonant chamber to vibrate the vibrator.

DETAILED DESCRIPTION OF THE PREFERRED EMBODIMENT

Figure 1:
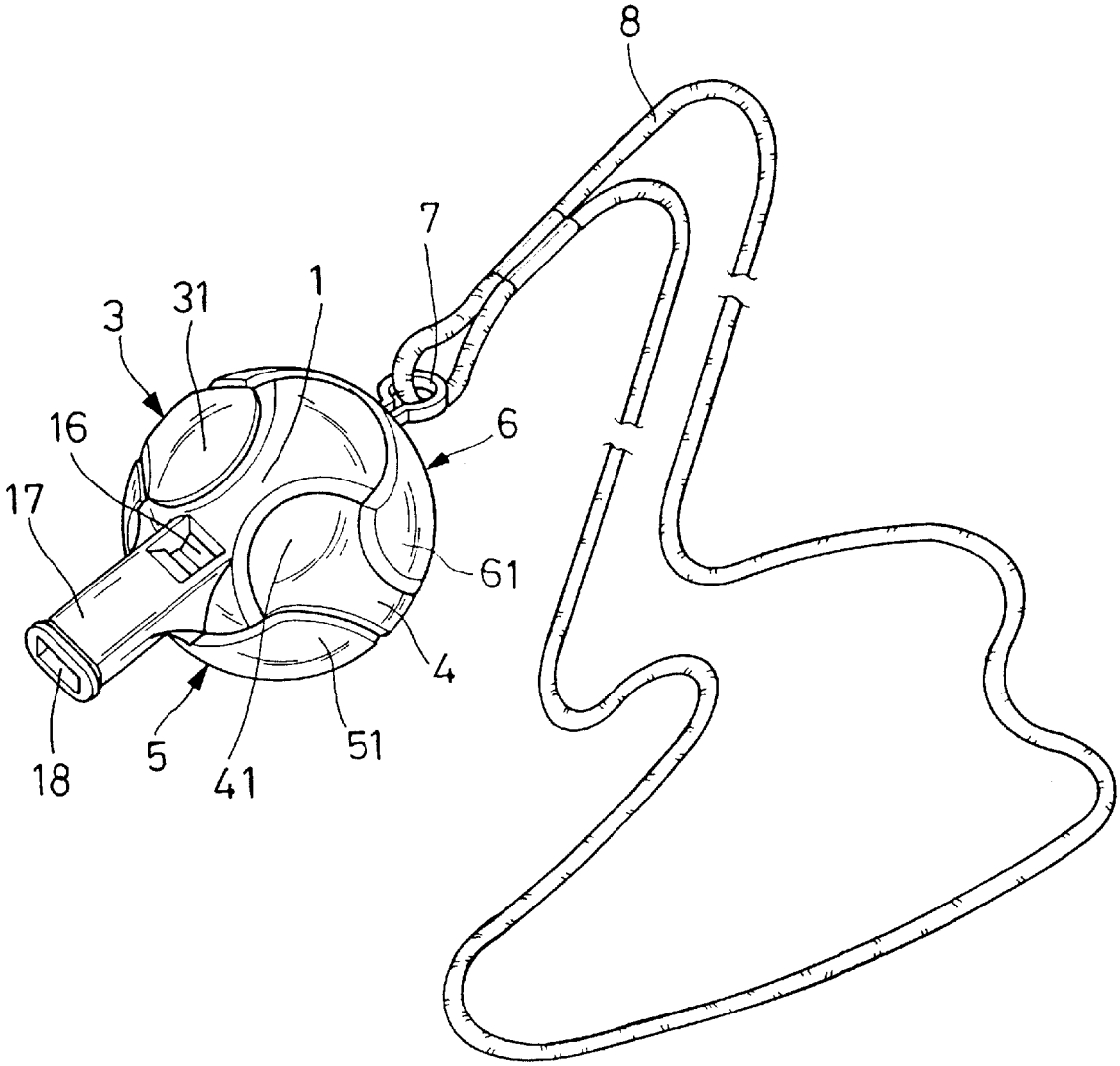
FIG. 1 is a perspective view of a combination spherical whistle according to the present invention.

Referring to FIGS. from 1 through 3, a combination spherical whistle is shown comprised of a plurality of whistle elements, namely, the top whistle element 1, the bottom whistle element 2, the left whistle element 3, the right whistle element 4, the front whistle element 5 and the rear whistle element 6, a split ring 7, and a cord 8. The whistle elements 1 through 6 are elongated, hollow, smoothly arched members fastened to one another, forming a spherical structure. Each whistle element 1, 2, 3, 4, 5 or 6 comprises two smoothly curved end portions 11, 21, 31, 41, 51 or 61 at two distal ends, two bearing faces 12, 22, 32, 42, 52 or 62 bilaterally symmetrically disposed in the middle between the smoothly curved end portions 11, 21, 31, 41, 51 or 61, two symmetrical pairs of hooked portions 13, 23, 33, 43, 53 or 63 respectively provided at the connecting areas between the smoothly curved end portions 11, 21, 31, 41, 51 or 61 and the bearing faces 12, 22, 32, 42, 52 or 62. By hooking the hooked portions 13, 23, 33, 43, 53 or 63 at one whistle element 1, 2, 3, 4, 5 or 6 to the hooked portions at another, the whistle element 1, 2, 3, 4, 5 and 6 are fastened together, forming a spherical structure. The front whistle element 5 and the rear whistle element 6 each further comprise a trapezoidal recess 521 or 621 at one bearing face 52 or 62. The rear whistle element 6 further comprises a coupling hole 64 on the middle for the mounting of the split ring 7. The split ring 7 is fastened to the coupling hole 64 at the rear whistle element 6 to hold the cord 8. Through the cord 8, the combination spherical whistle can be hung on, for example, the user's neck. The top whistle element 1 further comprises an air outlet 16 at the top adjacent to one end portion 11, and a mouthpiece 17 formed integral with one end portion 11 adjacent to the air outlet 16. The mouthpiece 17 defines an air inlet 18.

Figure 2:
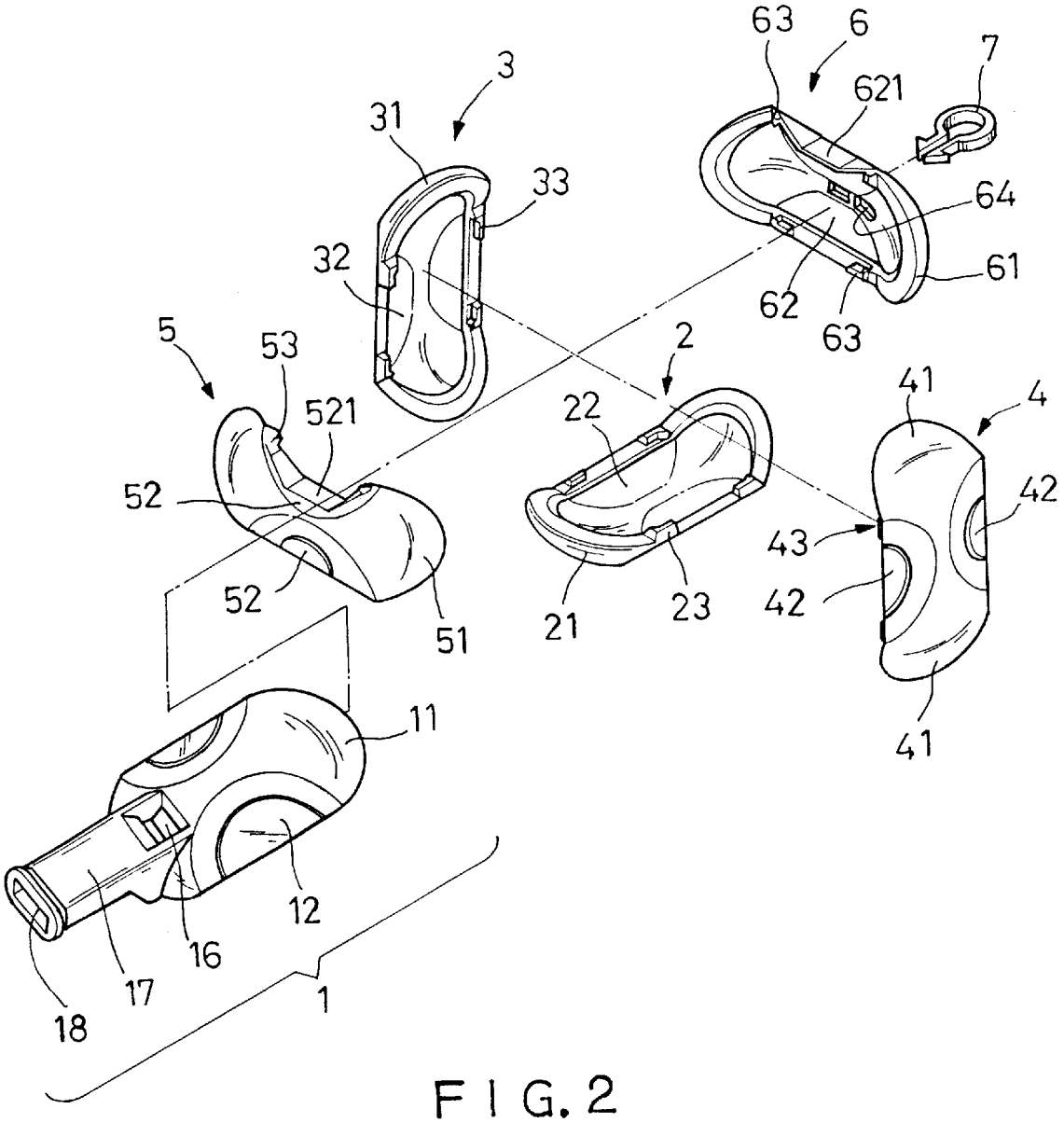
FIG. 2 is an exploded view of the combination spherical whistle shown in FIG. 1 (the cord excluded).
Figure 3A:
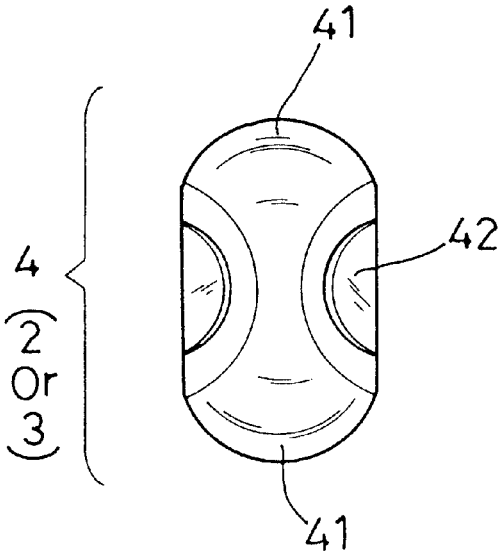
FIG. 3A is a top view of the right whistle element for the combination spherical whistle according to the present invention.
Figure 3B:
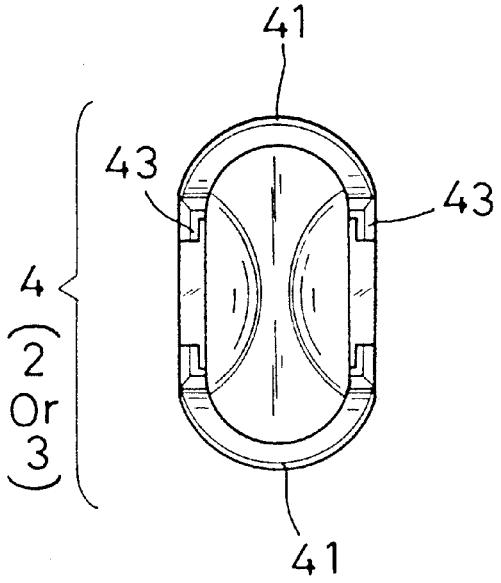
FIG. 3B is a bottom view of the right whistle element for the combination spherical whistle according to the present invention.
Figure 6:
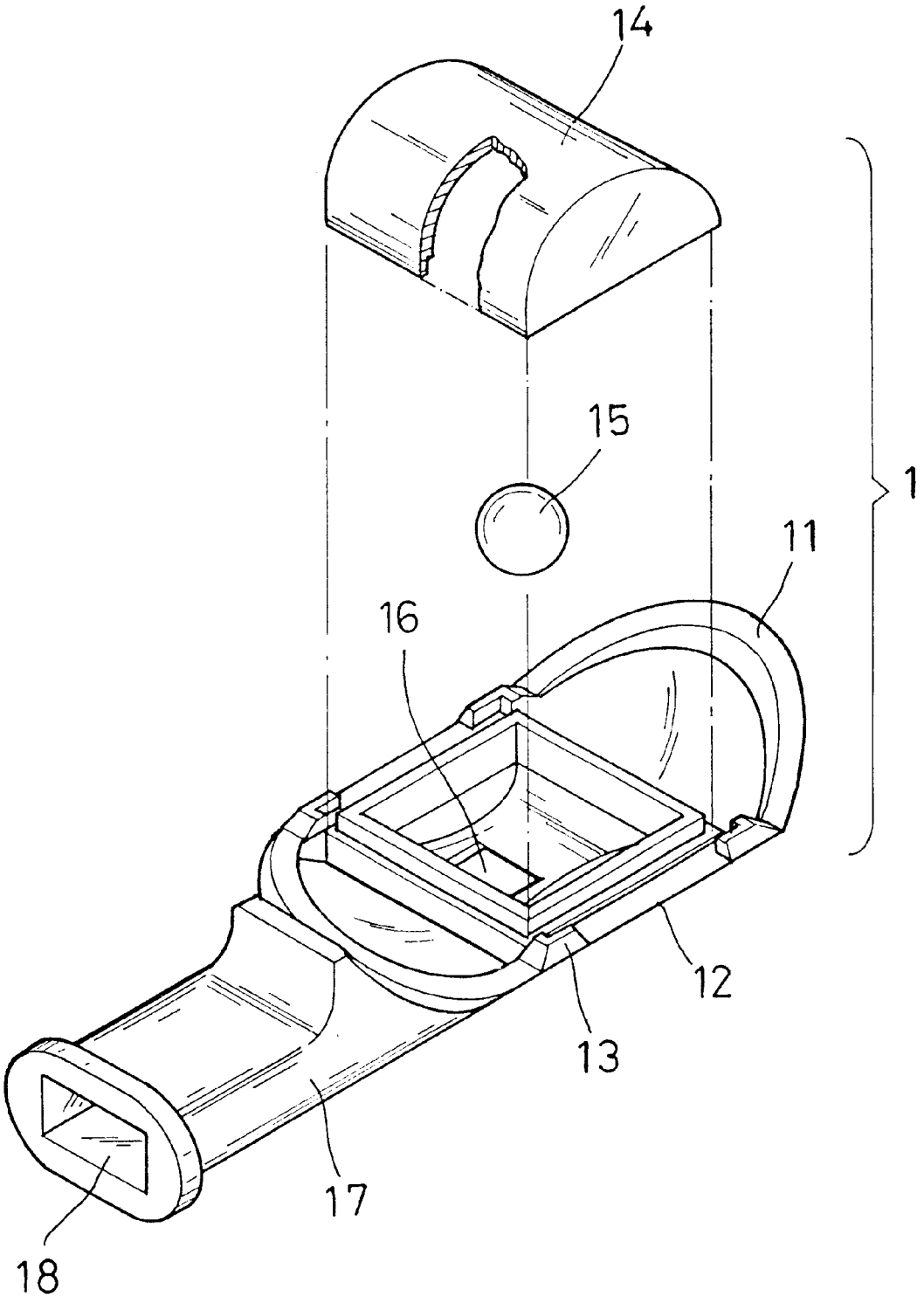
FIG. 6 is an exploded view of the top whistle element for the combination spherical whistle according to the present invention.

Referring to FIG. 6 and FIGS. 1 and 2 again, a cover plate 14 is covered on the inside wall of the top whistle element 1. The cover plate 14 defines with the top whistle element 1 a resonant chamber, which is disposed in communication with the air outlet 16 and the air inlet 18. A spherical vibrator 15 is received in the resonant chamber within the cover plate 14 and the top whistle element 1. When the user blows the mouthpiece 17, a rush current of air is driven into the resonant chamber toward the air outlet 16, and the vibrator 15 is rotated in the resonant chamber inside the cover plate 14 and the top whistle element 1, thereby causing a sharp sound to be produced.

Figure 4:
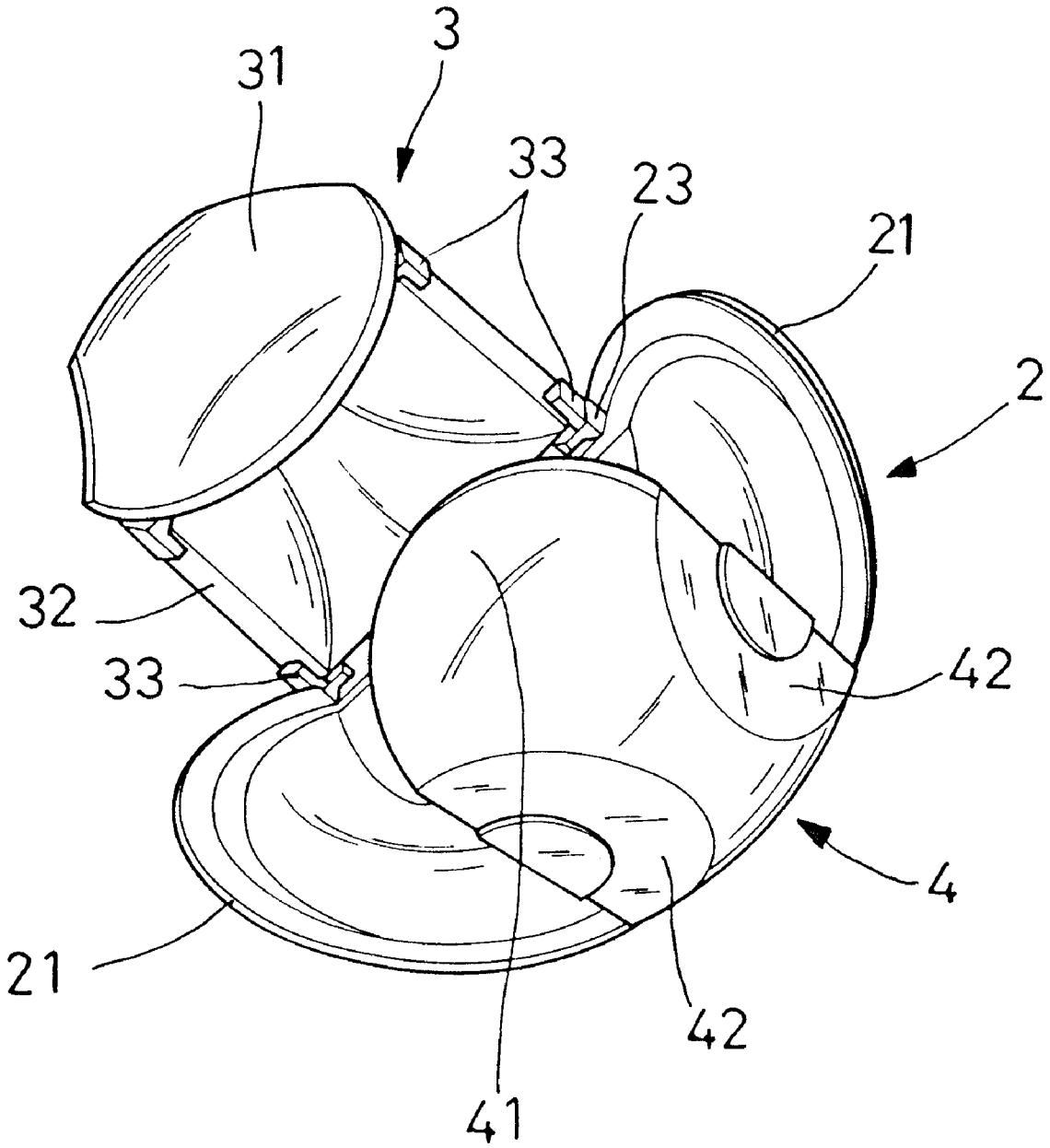
FIG. 4 illustrates the left whistle element and the right whistle element fastened to the bottom whistle element according to the present invention.
Figure 5:
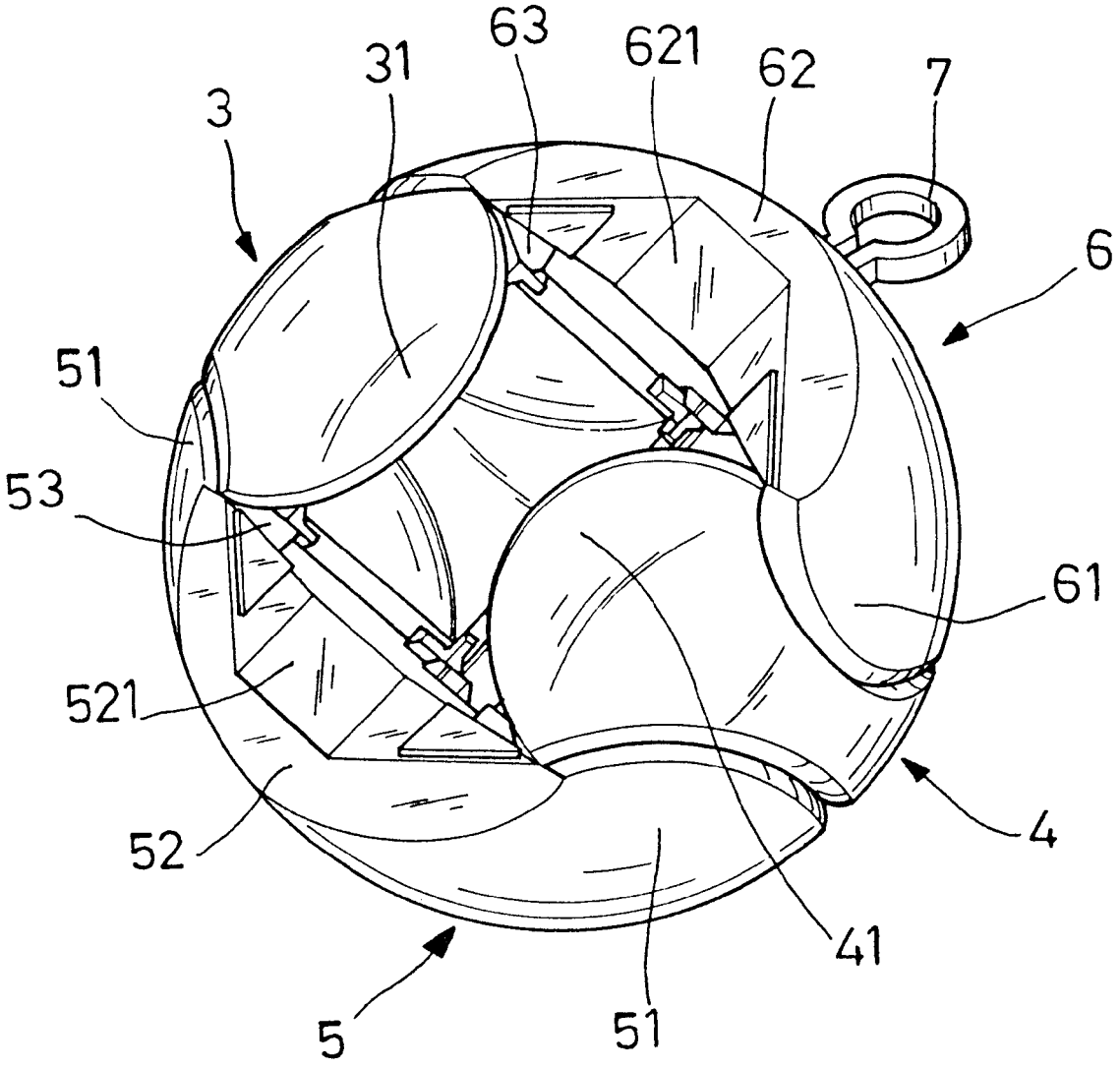
FIG. 5 illustrates the bottom whistle element, the left whistle element, the right whistle element, the front whistle element and the rear whistle element fastened together according to the present invention.

The assembly process of the present invention is simple, and outlined hereinafter with reference to FIGS. 4 and 5 and FIGS. 1 and 2 again. One end portion 31 of the left whistle element 3 and one end portion 41 of the right whistle element 4 are respectively attached to the bearing faces 22 of the bottom whistle element 2, enabling one pair of hooked portions 33 of the left whistle element 3 and one pair of hooked portions 43 of the right whistle element 4 to be respectively forced into engagement with the hooked portions 23 of the bottom whistle element 2, then the front whistle element 5 and the rear whistle element 6 are respectively bilaterally fastened to the left whistle element 3 and the right whistle element 4 by: attaching the end portions 51 of the front whistle element 5 and the end portions 61 of the rear whistle element 6 to the bearing faces 32 of the left whistle element 3 and the bearing faces 42 of the right whistle element 4 and then forcing one pair of hooked portions 53 of the front whistle element 5 and one pair of hooked portions 63 of the rear whistle element 6 into engagement with the corresponding hooked portions 33 and 43 at the left whistle element 3 and right whistle element 4, and then the top whistle element 1 is fastened to the front whistle element 5 and the rear whistle element 6 by: attaching the end portions 11 of the top whistle element 1 to one bearing face 52 at the front whistle element 5 and one bearing face 62 at the rear whistle element 6 and then forcing the hooked portions 13 of the top whistle element 1 into engagement with the corresponding hooked portions 53 and 63 at the front whistle element 5 and rear whistle element 6. Through the trapezoidal recess 521 at the front whistle element 5 and the trapezoidal recess 621 at the rear whistle element 6, the end portions 11 of the top whistle element 1 can easily be inserted into position.

While only one embodiment of the present invention has been shown and described, it will be understood that various modifications and changes could be made thereunto without departing from the spirit and scope of the invention disclosed.

What the invention claimed is:

1. A combination spherical whistle, comprising a top whistle element, a bottom whistle element, a front whistle element, a rear whistle element, a left whistle element, and a right whistle element, said whistle elements being elongated, hollow smoothly arched members fastened to one another, forming a spherical structure, said whistle elements each comprising two smoothly curved end portions at two distal ends, two bearing faces bilaterally symmetrically disposed in the middle between said smoothly curved end portions, two symmetrical pairs of hooked portions respectively provided at connecting areas between said smoothly curved end portions and said bearing faces, the end portions of each of said whistle elements being respectively attached to the bearing faces of other said whistle elements, the hooked portions of each of said whistle elements being hooked up with the hooked portions of other said whistle elements, wherein: said front whistle element and said rear whistle element each further comprise a trapezoidal recess at one bearing face; said top whistle element further comprises an air outlet, a mouthpiece formed integral with one end portion thereof adjacent to said air outlet and defining an air inlet, a cover plate fastened to an inside wall thereof and defining a resonant chamber in communication between said air inlet and said air outlet, and a vibrator received in said resonant chamber.

* * * * *